United States Patent [19]

Fishman

[11] Patent Number: 4,774,149

[45] Date of Patent: Sep. 27, 1988

[54] OXIDATION-AND HOT CORROSION-RESISTANT NICKEL-BASE ALLOY COATINGS AND CLADDINGS FOR INDUSTRIAL AND MARINE GAS TURBINE HOT SECTION COMPONENTS AND RESULTING COMPOSITE ARTICLES

[75] Inventor: Marvin Fishman, Schenectady, N.Y.

[73] Assignee: General Electric Company, Schenectady, N.Y.

[21] Appl. No.: 26,932

[22] Filed: Mar. 17, 1987

[51] Int. Cl.[4] ..... B32B 15/00

[52] U.S. Cl. ..... 428/680; 420/443; 420/588

[58] Field of Search ..... 428/678, 679, 680; 420/443, 588

[56] References Cited

U.S. PATENT DOCUMENTS

| | | | |
|---|---|---|---|
| 3,479,157 | 11/1969 | Richards et al. | 29/194 |
| 3,787,202 | 1/1974 | Mueller et al. | 75/134 |
| 3,904,382 | 9/1975 | Beltran et al. | 29/194 |
| 3,907,552 | 9/1975 | Kennedy | 75/122 |
| 4,022,587 | 5/1977 | Wlodek | 75/171 |
| 4,039,330 | 8/1977 | Shaw | 75/171 |
| 4,063,934 | 12/1977 | Thuillier et al. | 75/122 |
| 4,118,224 | 10/1978 | Wang et al. | 75/171 |
| 4,130,420 | 12/1978 | Firnhaber | 75/134 |
| 4,137,074 | 1/1979 | Firnhaber | 75/134 |
| 4,144,380 | 3/1979 | Beltran et al. | 428/679 |
| 4,152,488 | 5/1979 | Schilke et al. | 428/678 |
| 4,174,964 | 11/1979 | Shaw et al. | 75/122 |
| 4,313,760 | 2/1982 | Dardi et al. | 106/1.12 |
| 4,339,509 | 7/1982 | Dardi et al. | 428/632 |
| 4,419,416 | 12/1983 | Gupta et al. | 428/656 |

OTHER PUBLICATIONS

NAVSEA Marine Gas Turbine Materials Development Program, Naval Engineers Journal, Aug. 1981, Sam B. Shepard.

Phase Stability of High-Temperature Coatings on Ni-Cr-Base Alloys, Text from Brown Boveri & Cie AG, Heidelberg, West Germany.

Metallic Coating Development and Evaluation Program, Eleventh Quarterly Technical Report Under Contract No. N00024-78-C-5337, Aug. 10, 1981, C. S. Giggins et al.

Flame Spraying Superalloy Components to Improve Oxidation and Corrosion Resistance at High Temperatures, Industrial Heating, 3/81.

Sulphidation Behaviour of Nickel-and Cobalt-Based Alloys, SNECMA, B.P. 81, 91003 Evry Cedex, France.

H. Gilder et al. NICROBRAZ Engineering Data Sheet, Copyrighted 1973.

*Primary Examiner*—R. Dean

*Attorney, Agent, or Firm*—Jerome C. Squillaro

[57] ABSTRACT

New hot corrosion-and oxidation-resistant nickel-base alloys consisting essentially of about 40% chromium, 3% hafnium, 3% silicon, 0.2% yttrium, 0.5% titanium, up to 11% cobalt, remainder nickel are used to provide novel composite articles of nickel-base superalloy gas turbine hot section components having deposited coatings or bonded claddings of these protective alloys.

13 Claims, 8 Drawing Sheets

OXIDATION-AND HOT CORROSION-RESISTANT NICKEL-BASE ALLOY COATINGS AND CLADDINGS FOR INDUSTRIAL AND MARINE GAS TURBINE HOT SECTION COMPONENTS AND RESULTING COMPOSITE ARTICLES

FIELD OF THE INVENTION

The present invention relates generally to the superalloy branch of the metallurgical art, and is more particularly concerned with oxidation-and hot corrosion-resistant nickel-base alloys and with novel industrial and marine gas turbine superalloy hot stage components coated or clad with these new alloys and consequently having long duration service lines.

BACKGROUND

Protective coatings are vital to the continued performance and life of industrial and marine gas turbines, the hot section components of which are subjected to hostile enivornments at temperatures between 1300° F. and 1800° F. Because blade and vane alloy compositions meeting mechanical property requirements do not exhibit acceptable sulfidation/oxidation resistance for sustained operation in marine and industrial gas turbines, it is necessary to provide protective coatings which are metallurgically stable adn compatible with the substrate alloy and do not significantly degrade its mechanical properties at operating temperatures.

Aluminum, silicon and chromium are the only three alloying elments which form self-healing protective oxide surface layers oon nickel-, cobalt- and iron-base superalloys. Early prior art includes aluminide coatings which are more protective at higher temperatures and chromium and silicon coatings which perform better at the lower end of the temperature spectrum experienced by gas turbine hot sections. Also included in prior art are the MCrAlY class of coatings where M represents iron, cobalt, nickel or certain combinations thereof. In some service environments, MCrAlY coatings have demonstrated an advantage over aluminide coatings relative to corrosion resistance and ductility. All heretofore known coatings for superalloy blades/buckets, however, have deficiencies that limit their usefulness. The long-sought goal for coating developers has been to eliminate those deficiencies and to broaden the protective temperature range.

SUMMARY OF THE INVENTION

The overlay coating and cladding alloy compositions of this invention provide long term sulfidation (hot corrosion) protection for nickel-base superalloy parts operating up to 1600° F., metallurgical compatibility with most commercial substrate compositions, and unusual ductility and resistance to cracking under mechanically- or thermally-induced strain. For the majority of marine and industrial gas turbine blade/bucket applications operating within the 1300° to 1600° F. temperature range, hot corrosion protection over the expected life of the part can be achieved with the alloy compositions of this invention. This represents a breakthrough accomplishment in a crowded art for the marketing of new gas turbines and for the refurbishment of used blades and/or buckets.

One of the major findings of this invention is that hot corrosion resistance up to 1450° F. can be substantially enhanced by eliminating aluminum while increasing the chromium content to levels generally not found in prior art NiCrAlY coatings. Another major discovery of mine is that the corrosion life and ductility of high chromium-nickel alloy coatings between 1300°-1600° F. can be greatly enhanced through addition of relatively small, but critical, amounts of silicon, hafnium and yttrium. Further, I have found that by replacing part of the nickel of these new alloys with cobalt, hot corrosion resistance at 1600° F. can be importantly increased. This improvement can be obtained by incorporating 9 to 11% cobalt, preferably 10%, in place of nickel in these alloys without sacrificing ductility.

The reasons for the significant increase in protective life are not well understood, but some conjectures can be made. There is ample evidence that hafnium getters sulfur much more effectively than do chromium, titanium or manganese in a hot corrosion environment, leaving more of the chromium available for protective oxide formation. In addition, hafnium and yttrium inhibit spallation of hte protective oxide scale for extended periods of time. There is also a possibility that the yttrium increases the diffusion rate of silicon to the metal-oxide interface, promoting the formation of a continuous silica subscale that tends to slow oxide growth.

Not only is aluminum detrimental in the respect indicated above, but also it diminishes the important ductility property of the new alloys of this invention. Accordingly, care is preferably taken to avoid incorporation of aluminum in these alloys. It will be recognized, however, that relatively small amounts of aluminum such as up to about one percent may be tolerated and that if the amount is increased above that level, the penalty to hot corrosion resistance and ductility rapidly increases and quickly reaches the point (i.e. about two percent) where the new results and advantages of the invention are lost for all practical purposes.

Described broadly and generally, the novel article of this invention is a gas turbine hot section superalloy component coated or clad with a protective nickel-base alloy which consists essentialy of chromium, hafnium, silicon, yttrium, titanium. This coating or cladding alloy contains no aluminum which is a constituent of protective coatings and claddings for superalloys in the prior art. Further, the proportions of the constituents in the present novel protective alloys are 30–44% chromium, 0.5–10% hafnium, 0.5–4% silicon, 0.1–1% yttrium, 0.3–3% titanium, up to 11% cobalt, balance nickel, but the preferred range is 38–42% chromium, 2.5–3.5% hafnium, 2–4% silicon, 0.1–0.3% yttrium, 0.3–0.7% titanium, 9–11% cobalt, balance nickel. In an optimum form the NiCrHfSiTiY alloy of this invention consists essentially of about 40% chromium, about 3% hafnium, about 3% silicon, about 0.2% yttrium, about 0.5% titanium, balance nickel. In another such form of this invention the NiCoCrHfSiTiY alloy consists essentially of about 40% chronium, about 2.5% hafnium, about 10% cobalt, about 3% silicon, about 2.5% titanium, about 0.3% yttrium, remainder nickel.

BRIEF DESCRIPTION OF THE DRAWINGS

In the drawings accompanied and forming a part of the specification.

DETAILED DESCRIPTION OF PREFERRED EMBODIMENTS

In order to obtain satisfactory coating performance, alloy melting and conversion-to-powder techniques must restrict oxygen and nitrogen levels to a maximum of 500 and 300 ppm (parts per million), respectively, in the final powder product. When the new alloys of this invention are applied as overlay coatings, the preferred deposition procedures are low pressure (i.e. vacuum) plasma spray, electron beam physical vapor deposition (PVD), or argon-shrouded plasma spray. All three processes provide satisfactory thickness and composition control for marine and industrial gas turbine applications.

When the new alloys hereof are employed as airfoil claddings, my preference is to roll the alloy to thin sheet and to bond it in that form to the cast superalloy substrate by hot isostatic pressing (HIP'ing).

After deposition of the coating, the coated articles are best heat treated under protective atmosphere (vacuum or argon) for one or more of the following reasons:

(1) to increase coating density;

(2) to improve adherence to the substrate;

(3) to restore optimum properties to the substrate.

Heat treat time and temperature will vary with different superalloy substrates.

Figure 6:
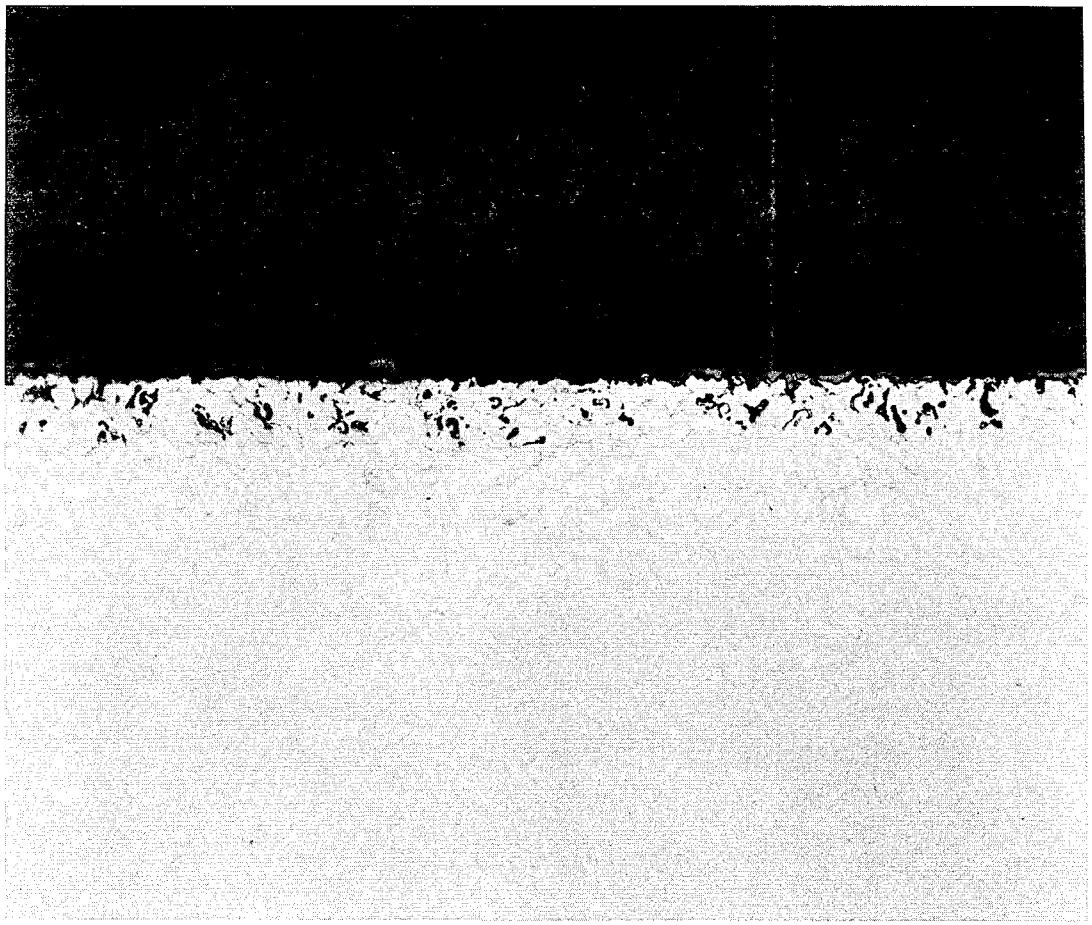
FIG. 6 is a photomicrograph (200X) of a cast bulk specimen of the NiCoCrHfSitiY alloy of this invention in non-oxidized condition tested under the FIG. 2 conditions except that the test temperature was 1600° F. and the test duration was 1,000 hours.
Figure 7:
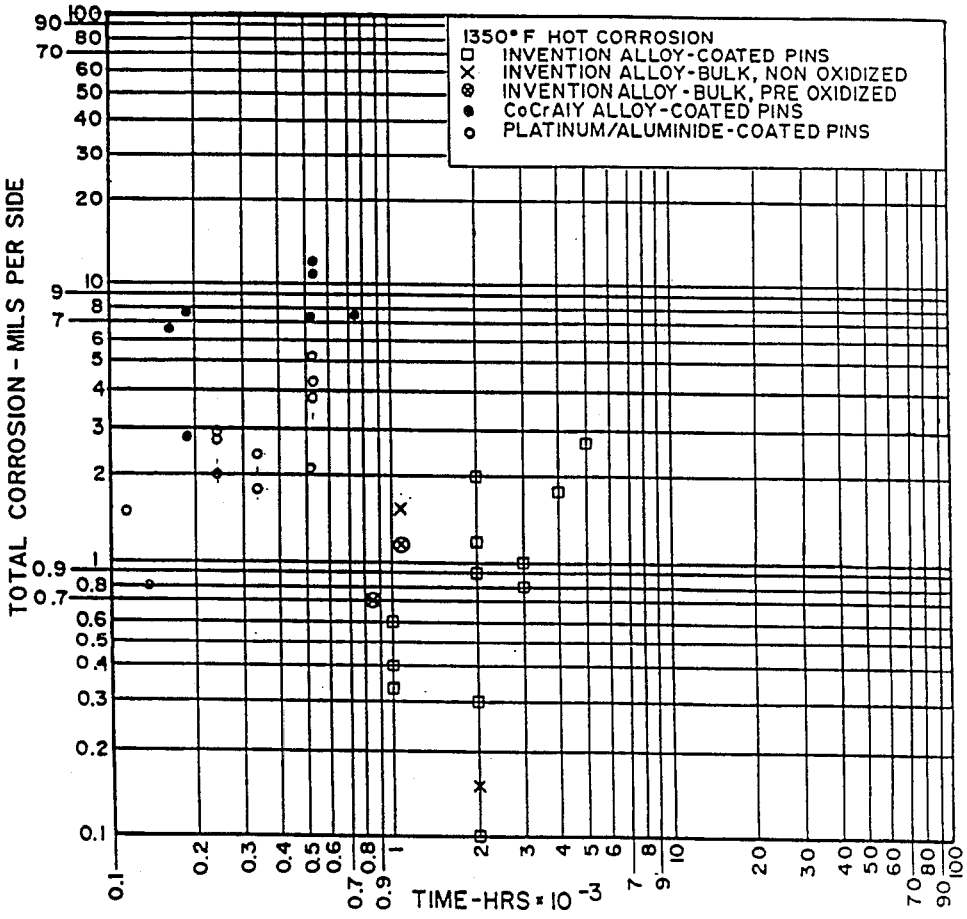
FIG. 7 is a chart on which total corrosion in mils per side is plotted against time in hours, the results at 1350° F. of specimens embodying this invention and those of two selected prior art compositions being indicated by points plotted on the chart as designated.
Figure 8:
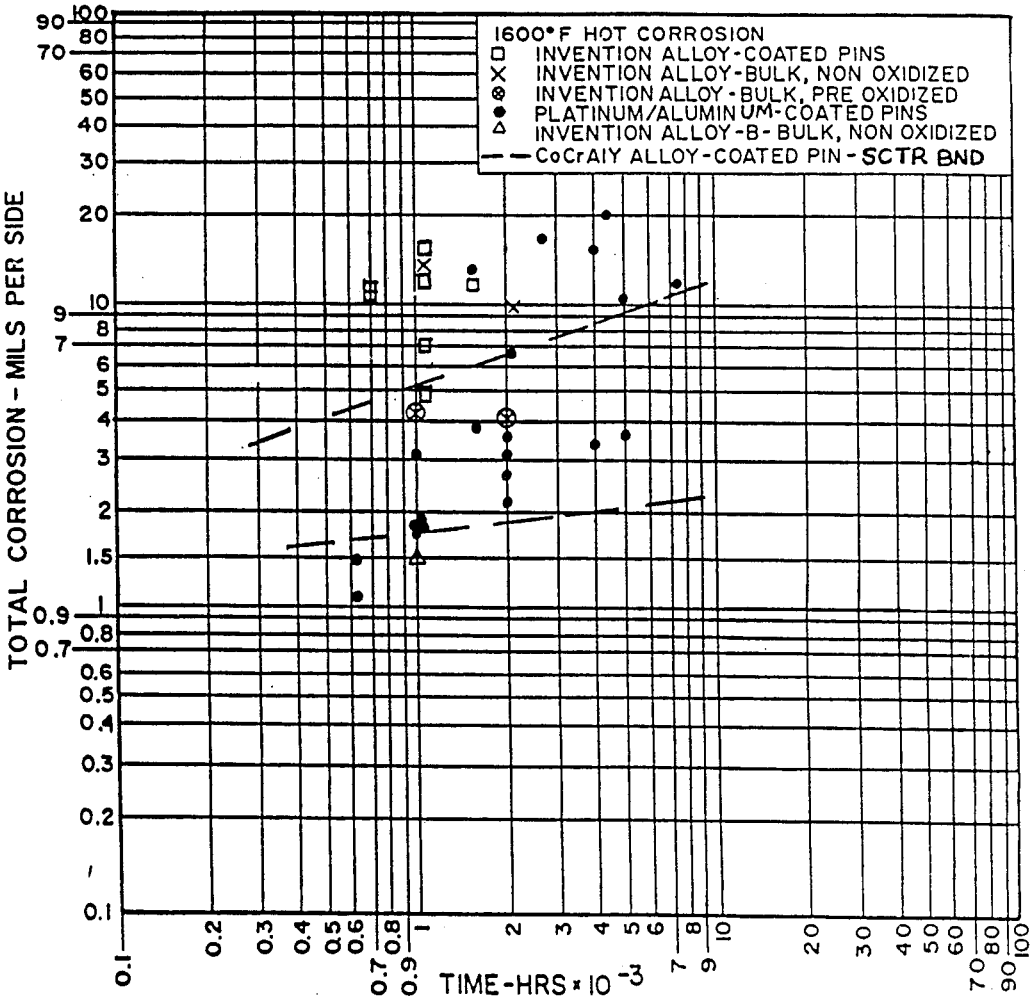
FIG. 8 is another chart like that of FIG. 7 in which the present invention NiCrHfSiTiY alloy and NiCoCrHfSiTiY (designated Invention Alloy-B) are plotted as points of 1600° F. test data along with the data for the two prior art alloys of FIG. 7.

The hot corrosion results represented by the photomicrographs of FIGS. 2,3,4,6 and the charts of FIG. 7 and 8 were obtained from burner rig tests at 1350° F. and 1600° F. conducted on IN 738 pin substrates coated with a preferred alloy composition of the present invention, on bulk alloy disc specimens of two preferred alloy compositions of this invention, and on IN-738 pin substrates some of which were coated with platinum-aluminum and some with a CoCrAlY alloy. The latter two prior art coatings were selected for comparative test purposes because they are in wide current use and are generally recognized as being the best commercially available for corrosion protection of industrial turbine buckets. The preferred alloy compositions of this invention used in the corrosion rig testing consisted essentially of 40% chromium, 3% hafnium, 3% silicon, 0.2% yttrium, 0.5% titanium, remainder nickel and the NiCoCrHfSiTiY alloy designated above as Invention Alloy - B.

The preferred NiCrHfSiTiY coatings of this invention and the CoCrAlY coating were applied to IN 738 alloy test specimens by the vacuum plasma spray technique widely used in commercial production of MCrAlY coated gas turbine components. The platinum aluminum coating was provided by the standard electroplating and pack coating technique employed to commercially coat such nickel-base articles. Test specimen coating thickness ranted from approximately 4 mils for the platinum aluminum and CoCrAlY compositions to approximately 7 mils for the alloy of this invention. The bulk test specimens of the NiCrHfSiTiY alloy of this invention, as noted above, were machined from small castings and evaluated in the non-oxidized condition as well as in a pre-oxidized condition produced by 24 hour exposure in air at 1900° F. The alloy B-bulk test specimen ws also machined from a small casting and evaluated in non-oxidized condition.

A standard burner rig was used in all the experiments reported herein and in each case rig pressure and temperature conditions were the same, being one atmosphere gage pressure and 1350°0 F. in one series and 1600° F. in the other. The fuel was likewise the same in each case, being #2 diesel oil doped with tertiary butyl disulfide (to obtain 1% sulfur) and with about 500 ppm synthetic sea salt. Sufficient $SO_2$ was added to the combustion air to achieve sulfur levels comparable to those prevailing in normal marine and industrial gas turbine operation.

The data obtained in each of these experiments are identified and distinguished from the data of all the other experiments in the series as shown by the key at the upper right corner of the charts of FIGS. 7 and 8.

As illustrated, the specimens representing the present invention, particularly the coated bodies were clearly substantially superior in performance to the prior art coatings at 1350° F. Thus, there was complete penetration of the CoCrAlY composition in 170 hours and about 80% penetration of the platinum aluminide coating in 250 hours. Penetration of the coating of this invention to the extent of as much as 50% of coating thickness (i.e. 3 mils), however, occurred only in the single instance after 5000 hours and in a number of other coated pin cases the coatings were still intact at 2000 hours and even 3000 hours. The penetration of the bulk alloy specimens in both non-oxidized and preoxidized condition was also considerably less than that in the case of the CoCrAlY and the platinum aluminum coatings for times in excess of 1000 hours.

At 1600° F., the NiCrHfSiTiY alloy of this invention was penetrated to depths of 4 to 12 mils in the case of cast bulk specimens and approximately 12.5 mils in coated pin specimens, after 1000 hours. The alloy - B cast bulk specimen however, was penetrated only to a depth of 1.5 mil after 1000 hours at 1600° F. When compared to the CoCrAlY corrosion data scatterbond and the data from the platinum aluminum-coated pins in FIG. 8, the beneficial effect of aluminum at higher temperatures is apparent. But it is also evident that such beneficial effect can be obtained without aluminum by substitution of cobalt for a minor part of the nickel of the present invention alloys.

Figure 1:
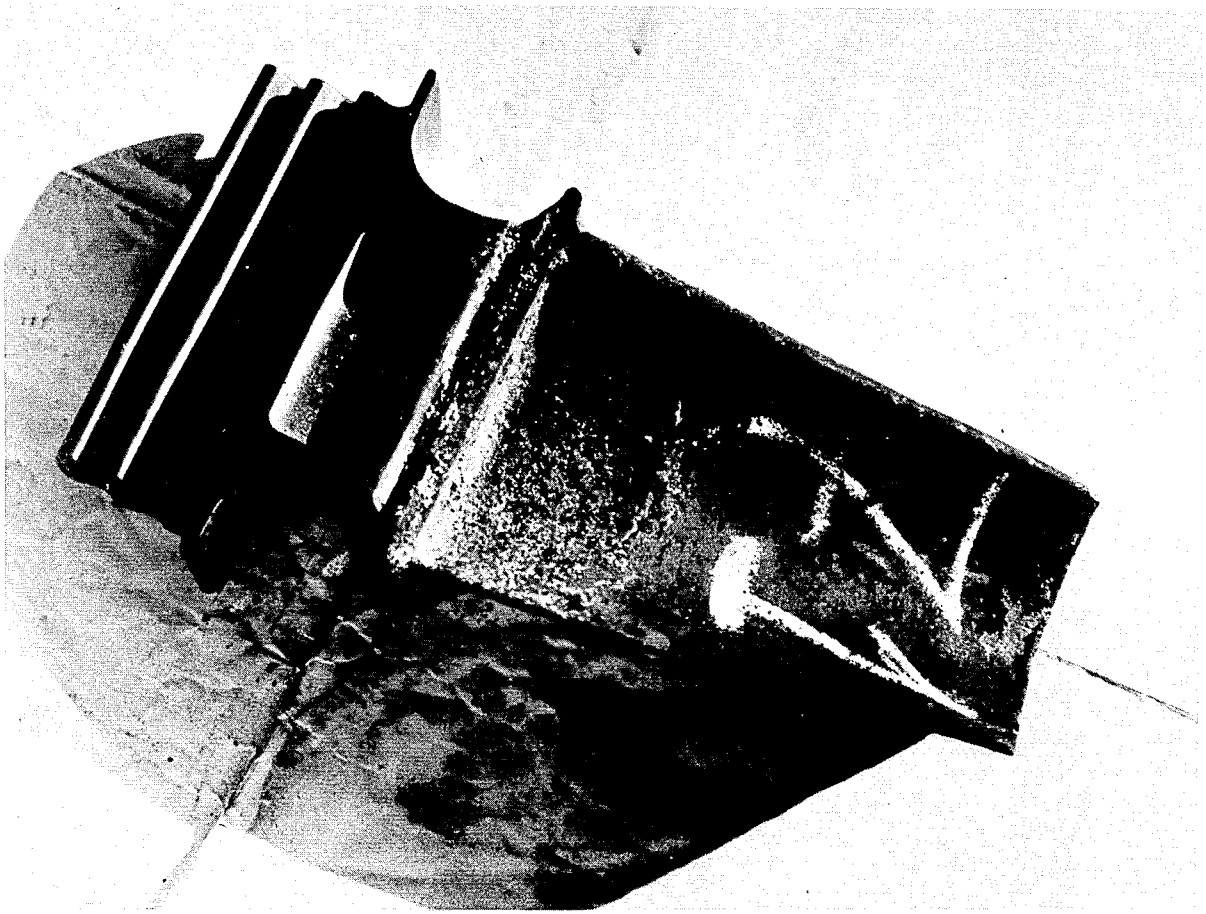
FIG. 1 is a photograph of a typical industrial gas turbine bucket to which the coatings or claddings of this invention are applied.
Figure 2:
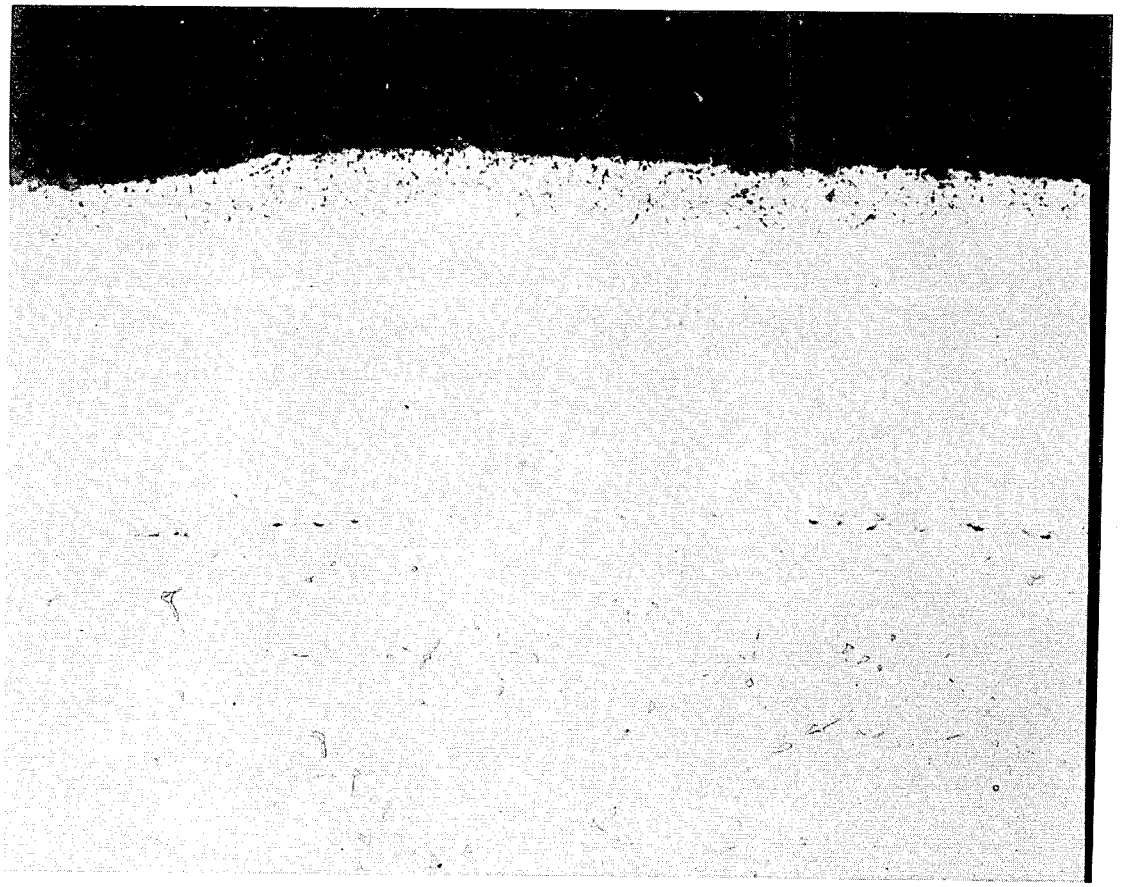
FIG. 2 is a photomicrograph (magnification 400 diameters) of a test specimen of nickel-base superalloy coated with NiCrHfSiTiY alloy of this invention which has been subjected to 1350° F. for 2,008 hours in a gas turbine burner rig.
Figure 3:
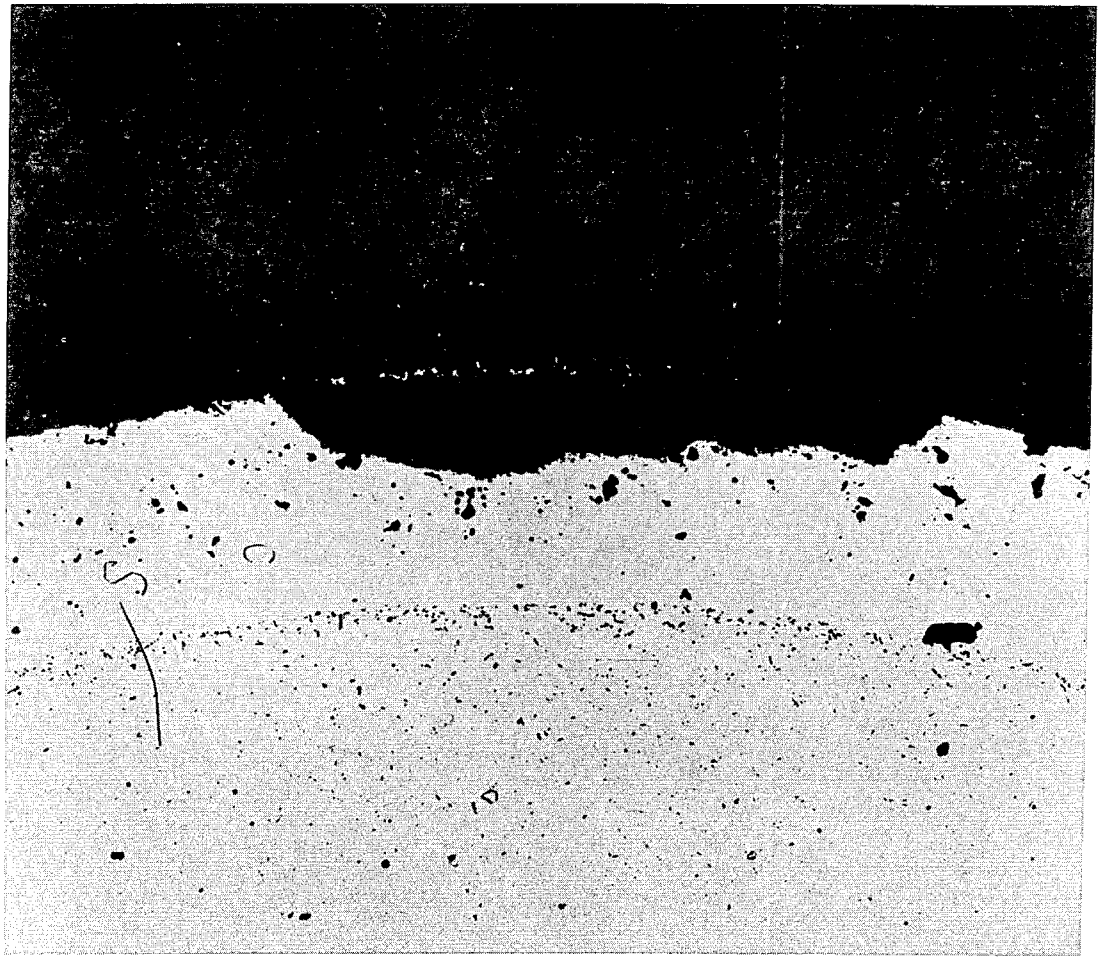
FIG. 3 is a photomicrograph like that of FIG. 2 (magnification 200 diameters) of a specimen of the superalloy substrate of FIG. 2 with a prior art coating, the specimen having been tested under the FIG. 2 conditions except that the duration of the test was only 188 hours.
Figure 4:
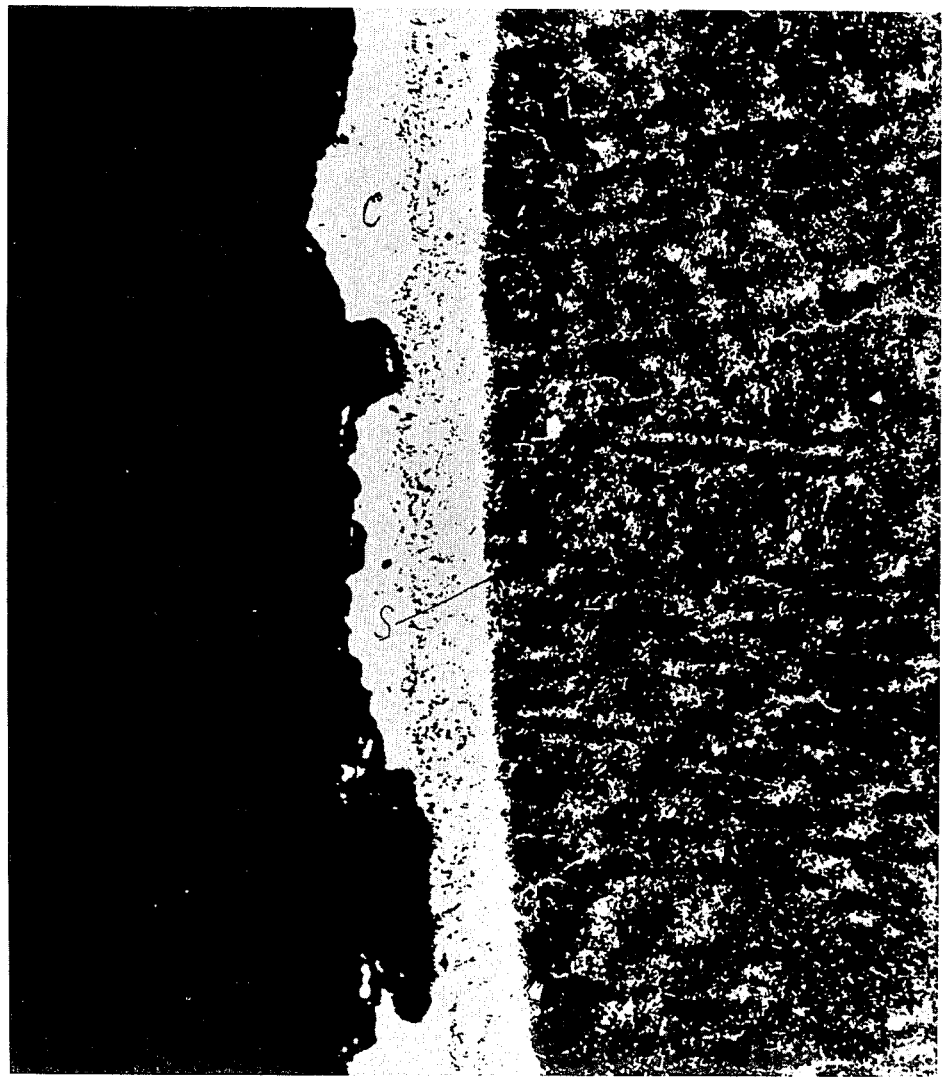
FIG. 4 is another photomicrograph like that of FIG. 2 (magnification 400 diameters) of a specimen of the superalloy substrate of FIG. 2 with still another prior art coating, the test being made under the FIG. 2 conditions except that the test duration was only 340 hours.
Figure 5:
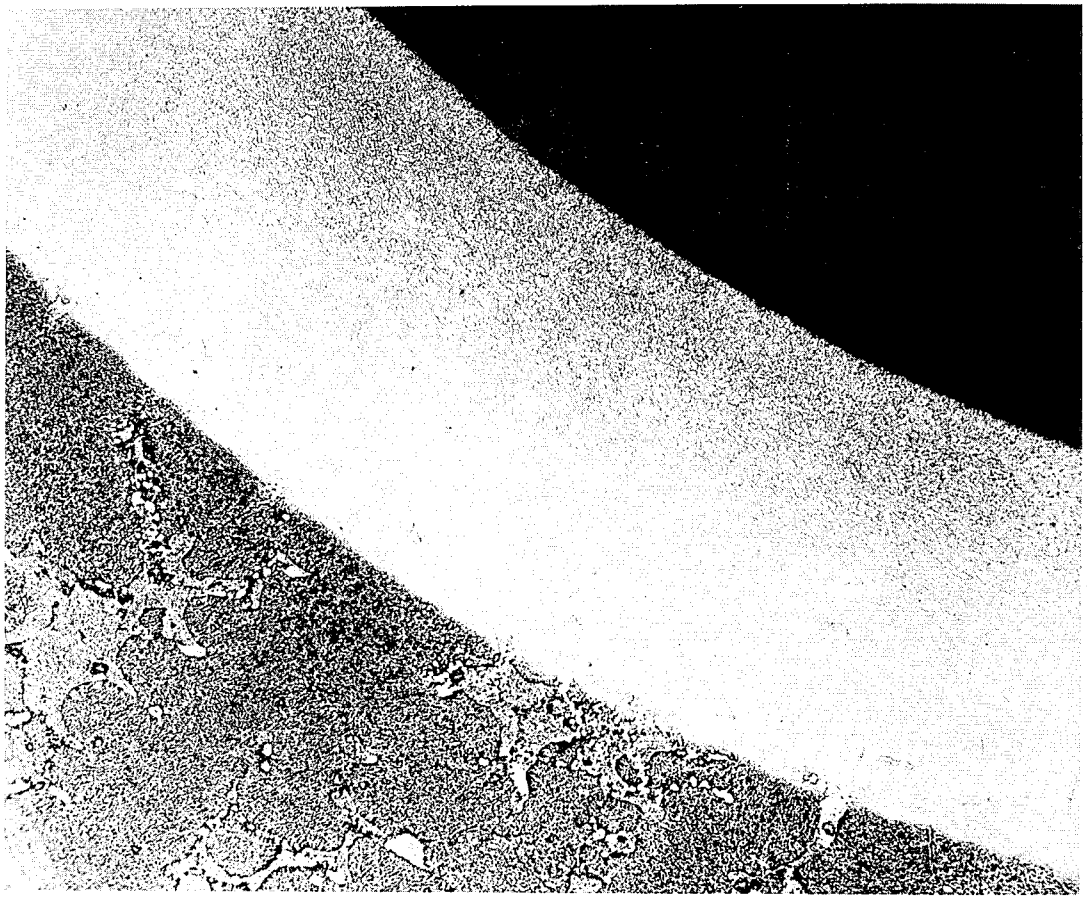
FIG. 5 is a photomicrograph (200X) of a portion of an industrial gas turbine bucket airfoil of the same substrate composition as that of FIG. 2 shown as-coated by low pressure plasma spray with an alloy of this invention.

The foregoing test results are further illustrated in the accompanying photomicrographs. Thus comparison of FIG. 2 with FIG. 3 reveals the dramatic difference between a coating of this invention and a CoCrAlY coating in respect to corrosion resistance at 1350° F. under the test conditions described above. Similarly, the relatively severe attack which occurred under the same conditions on a platinum aluminum pack coating is shown in FIG. 4. As a before-and-after reference, FIG. 5 is a photomicrograph of a NiCrHfSiTiY coated airfoil and in each of these four cases the alloy coating is designated C and the substrate is designated S. The protective alloy-covered gas turbine bucket airfoil of FIG. 1 is identified by reference character A.

The outstanding corrosion resistance of alloy-B of this invention is likewise evident from FIG. 6 which reveals only superficial attack on a bulk cast specimen under standard burner rig test conditions at 1600° F. for 1000 hours.

Tensile tests performed on specimens produced by vacuum plasma spraying free standing shapes with the Co-29Cr-6Al-1Y coating composition and with a preferred composition of this invention (consisting essentially of 40% chromium, 3% hafnium, 3% silicon, 0.2% yttrium, 0.5% titanium, balance nickel) show the significant difference in ductility at all temperatures between these two coating alloys, as is evident from the experimental data set out in Table I.

TABLE I

| Alloy | Temp, °F. | UTS, ksi | .2% YS, ksi | % El | % RA |
|---|---|---|---|---|---|
| NiCrHfSiTiY | Room | 162.9 | 146.9 | 2.7 | 4.0 |
| | 800 | 154.9 | 137.0 | 7.7 | 13.0 |
| | 1200 | 92.7 | 86.7 | 16.5 | 20.4 |
| | 1400 | 38.2 | 32.9 | 45.8 | 48.3 |
| | 1600 | 11.9 | 10.4 | 164.1 | 83.1 |
| Co—29Cr—6Al—1Y | Room | 186.2 | — | 0 | 1.2 |
| | 800 | 175.7 | 153.8 | 0.5 | — |
| | 1200 | 139.2 | 111.1 | 4.6 | 7.2 |
| | 1400 | 73.4 | 60.7 | 10.6 | 14.8 |
| | 1600 | 24.8 | 20.5 | 59.0 | 54.6 |

The good ductility of the NiCrHfSiTiY coating of this invention will reduce the fatigue life of a substrate alloy much less than prior art overlay coatings of comparable nature as well as pack coatings.

In the specification and in the appended claims wherever percentage or proportion is stated, it is with reference to the weight basis.

I claim:

1. An oxidation and hot corrosion-resistant composite article comprising of nickel-base superalloy gas turbine hot section component and a protective alloy covering bonded thereto consisting essentially of 30–44% chromium, 0.5–10% hafnium, 0.5–4% silicon, 0.1–1% yttrium, 0.3–3% titanium, up to 11% cobalt, remainder nickel.

2. An article of claim 1 in which the alloy covering is in the form of coating.

3. An article of claim 1 in which the covering is in the form of a spray deposited coating.

4. An article of claim 1 in which the covering is in the form of cladding bonded to the gas turbine hot section component substrate.

5. An article of claim 4 in which the cladding is bonded to the substrate body by hot isotatic pressing.

6. An article of claim 1 in which the alloy covering consists essentially of 38–42% chromium, 2.5–3.5% hafnium, 2–4% silicon, 0.1–0.3% yttrium, 0.3–1% titanium, remainder nickel.

7. An article of claim 1 in which the covering consists essentially of about 40% chromium, 3% hafnium, 3% silicon, 0.2% yttrium, 0.5% titanium, 10% cobalt, remainder nickel.

8. An oxidation-and hot corrosion-resistant alloy composition consisting essentially of 30–44% chromium, 0.5–10 % hafnium, 0.5–4% silicon, 0.1–1% yttrium, 0.3–3% titanium remainder nickel.

9. The alloy of claim 8 in which the alloy consists essentially of 38–42% chromium, 2.5–3.5% hafnium, 2–4% silicon, 0.1–0.3% yttrium, 0.3–1% titanium, remainder nickel.

10. The alloy of claim 8 consisting essentially of 40% chromium, 3% hafnium, 3% silicon, 0.2% yttrium, 0.5% titanium, remainder nickel.

11. The alloy of claim 8 containing 9-11% cobalt.

12. The alloy of claim 8 containing 10% cobalt.

13. The article of claim 1 in which the alloy covering consists essentially of about 40% chromium, 2.5% hafnium, 10% cobalt, 3% silicon, 2.5% titanium, 0.3% yttrium, remainder nickel.

* * * * *